US010109257B2

(12) United States Patent
Jin et al.

(10) Patent No.: US 10,109,257 B2
(45) Date of Patent: Oct. 23, 2018

(54) DRIVING METHOD OF DISPLAY PANEL AND DRIVING MODULE, DISPLAY PANEL AND DISPLAY APPARATUS

(71) Applicants: BOE Technology Group Co., Ltd., Beijing (CN); HEFEI BOE Optoelectronics Technology Co., Ltd., Hefei (CN)

(72) Inventors: Tingting Jin, Beijing (CN); Tao Yu, Beijing (CN); Qiang Lin, Beijing (CN); Hongxiang Xu, Beijing (CN); Qi Yang, Beijing (CN); Xuyang Fang, Beijing (CN); Yakun Wang, Beijing (CN)

(73) Assignees: BOE Technology Group Co., Ltd., Beijing (CN); Hefei BOE Optoelectronics Technology Co., Ltd., Hefei (CN)

( * ) Notice: Subject to any disclaimer, the term of this patent is extended or adjusted under 35 U.S.C. 154(b) by 85 days.

(21) Appl. No.: 15/126,892

(22) PCT Filed: Nov. 12, 2015

(86) PCT No.: PCT/CN2015/094428

§ 371 (c)(1),
(2) Date: Sep. 16, 2016

(87) PCT Pub. No.: WO2016/192313

PCT Pub. Date: Dec. 8, 2016

(65) Prior Publication Data

US 2018/0033393 A1 Feb. 1, 2018

(30) Foreign Application Priority Data

May 29, 2015 (CN) ..... 2015 1 0292713

(51) Int. Cl.
*G09G 5/00* (2006.01)

(52) U.S. Cl.
CPC ..... *G09G 5/006* (2013.01); *G09G 2300/0408* (2013.01); *G09G 2310/08* (2013.01); *G09G 2330/023* (2013.01)

(58) Field of Classification Search
CPC ..... G09G 2310/0286; G09G 3/3266; G09G 2310/0267; G09G 2310/0205; G09G 3/3674
See application file for complete search history.

(56) References Cited

U.S. PATENT DOCUMENTS

2003/0160753 A1 8/2003 McCartney
2006/0114216 A1* 6/2006 Shim ..... G09G 3/3677 345/100

(Continued)

FOREIGN PATENT DOCUMENTS

CN 101944346 A 1/2011
CN 201725544 U 1/2011

(Continued)

OTHER PUBLICATIONS

Sep. 5, 2017—(CN) Second Office Action Appn 201510292713.4 with English Tran.

(Continued)

*Primary Examiner* — Koosha Sharifi-Tafreshi
(74) *Attorney, Agent, or Firm* — Banner & Witcoff, Ltd.

(57) ABSTRACT

There are provided a driving method of a display panel and a driving module, a display panel and a display apparatus, which are capable of reducing power consumption of the display panel. The driving method of the display panel comprises: determining positions of gate lines to be scanned; determining offset current values according to the positions of the gate lines to be scanned; and generating driving signals of GOA units corresponding to the gate lines to be scanned according to the offset current values and clock signals of the display panel. The driving method of the display panel and the driving module, the display panel and the display apparatus determine the offset current values according to the positions of the gate lines to be scanned, and the amplitude of the offset current values only needs to (Continued)

ensure the normal display of the display panel when the gate lines to be scanned are scanned, thereby power consumption of the display panel is reduced.

20 Claims, 3 Drawing Sheets

(56) References Cited

U.S. PATENT DOCUMENTS

| | | | | |
|---|---|---|---|---|
| 2007/0080921 | A1* | 4/2007 | Wang | G09G 3/3677 345/100 |
| 2010/0128019 | A1 | 5/2010 | Harada | |
| 2012/0105393 | A1 | 5/2012 | Tan et al. | |
| 2016/0163287 | A1* | 6/2016 | Ahn | G09G 5/12 345/213 |
| 2016/0343333 | A1* | 11/2016 | Yu | G02F 1/13306 |

FOREIGN PATENT DOCUMENTS

| | | | |
|---|---|---|---|
| CN | 102411946 | A | 4/2012 |
| CN | 102881254 | A | 1/2013 |
| CN | 102982775 | A | 3/2013 |
| CN | 103426409 | A | 12/2013 |
| CN | 104036740 | A | 9/2014 |
| CN | 104361878 | A | 2/2015 |
| CN | 104851384 | A | 8/2015 |
| CN | 105118452 | A | 12/2015 |
| JP | 2014119750 | A | 6/2014 |

OTHER PUBLICATIONS

Dec. 30, 2016—(CN) First Office Action Appn 201510292713.4 with English Tran.

Feb. 25, 2016—(WO)—International Search Report and Written Opinion Appn PCT/CN2015/094428 with English Tran.

* cited by examiner

DRIVING METHOD OF DISPLAY PANEL AND DRIVING MODULE, DISPLAY PANEL AND DISPLAY APPARATUS

The application is a U.S. National Phase Entry of International Application No. PCT/CN2015/094428 filed on Nov. 12, 2015, designating the United States of America and claiming priority to Chinese Patent Application No. 201510292713.4 filed on May 29, 2015. The present application claims priority to and the benefit of the above-identified applications and the above-identified applications are incorporated by reference herein in their entirety.

TECHNICAL FIELD

The present disclosure relates to a driving method of a display panel and a driving module, a display panel and a display apparatus.

BACKGROUND

The technique of gate driver on array (GOA) refers to integration of a gate driving circuit on an array substrate of a display panel. The GOA circuit comprises GOA units connected in cascades, which are corresponding to different gate lines respectively. Driving signals of the GOA units are used to drive the GOA units to gate and/or scan corresponding gate lines.

Under the influence of factors such as panel load and so on, there is often a certain phase delay when the driving signals of the GOA units are transmitted to the GOA units. An increase of offset current of the driving signals of the GOA units would reduce the phase delay. Therefore, the phase delay could be controlled below a threshold by adjusting the amplitude of the offset current.

After experiment and study, the inventors find that when gate lines close to a source driving circuit are scanned, due to relatively short phase delay, it only needs a relatively small offset current to ensure the normal display of the display panel. It may result in power consumption waste if the offset current is set uniformly according to a maximum phase delay.

SUMMARY

There are provided in embodiments of the present disclosure a driving method of a display panel and a driving module, a display panel and a display apparatus, which are capable of reducing power consumption of the display panel.

According to one aspect of embodiments of the present disclosure, there is provided a driving method of a display panel which comprises a GOA circuit and L rows of gate lines, the GOA circuit providing gate driving signals to the L rows of gate lines, and the L being a positive integer, the method comprising:

determining positions of gate lines to be scanned;

determining offset current values according to the positions of the gate lines to be scanned; and generating driving signals of GOA units corresponding to the gate lines to be scanned according to the offset current values and clock signals of the display panel.

Optionally, the positions of the gate lines to be scanned are row numbers of the gate lines to be scanned;

An offset current configuration list is looked up according to the row numbers of the gate lines to be scanned, and offset current values corresponding to the row numbers of the gate lines to be scanned are determined.

Optionally, in the offset current configuration list, each row number of the L rows of gate lines is corresponding to one offset current value.

Optionally, in the offset current configuration list, an offset current value corresponding to each row number has a linear relationship with a distance between a gate line of the row number and a source driving circuit.

Optionally, the L rows of gate lines comprise at least a group of consecutive gate lines of a predetermined row number corresponding to a same offset current value, where the predetermined row number is smaller than L.

Optionally, determining offset current values according to positions of gate lines to be scanned comprises:

calculating and obtaining offset current values corresponding to the positions of the gate lines to be scanned by a predetermined formula.

Optionally, the driving signals of the GOA units comprise at least one clock driving signal; and when the GOA unit corresponding to the gate line to be scanned is a first stage of the GOA units, the driving signals of the GOA units further comprise a frame start signal STV.

According to another aspect of the embodiments of the present disclosure, there is provided a driving module of a display panel comprising a GOA circuit and L rows of gate lines, the GOA circuit providing gate driving signals to the L rows of gate lines, and the L is a positive integer, the driving module comprising:

a timing control unit, configured to determine positions of gate lines to be scanned;

an offset current control unit, configured to determine offset current values according to the positions of the gate lines to be scanned; and a level converting unit, configured to generate driving signals of GOA units corresponding to the gate lines to be scanned according to the offset current values and clock signals of the display panel.

Optionally, the positions of the gate lines to be scanned are row numbers of the gate lines to be scanned;

The offset current control unit can be configured to look up an offset current configuration list according to the row numbers of the gate lines to be scanned, and determine offset current values corresponding to the row numbers of the gate lines to be scanned.

Optionally, in the offset current configuration list, each row number of the L rows of gate lines is corresponding to one offset current value.

Optionally, in the offset current configuration list, the offset current values corresponding to each row number have a linear relationship with a distance between the gate lines of the row numbers and a source driving circuit.

Optionally, the L rows of gate lines comprise at least a group of consecutive gate lines of a predetermined row number corresponding to a same offset current value, where the predetermined row number is smaller than L.

Optionally, the offset current control unit can be configured to calculate and obtain offset current values corresponding to the positions of the gate lines to be scanned by a predetermined formula.

According to another aspect of the embodiments of the present disclosure, there is provided a display panel, comprising the driving module described above.

According to another aspect of the embodiments of the present disclosure, there is provided a display apparatus, comprising the display panel described above.

The driving method of the display panel provided in the embodiments of the present disclosure, determines the offset current values according to the positions of the gate lines to be scanned by determining the positions of the gate lines to be scanned, and generates the driving signals of the GOA units corresponding to the gate lines to be scanned according to the offset current values and the clock signals of the display panel, so as to complete scanning of the gate lines to be scanned. The embodiments of the present disclosure determines the offset current values according to the positions of the gate lines to be scanned, and the amplitude of the offset current values only needs to ensure the normal display of the display panel when the gate lines to be scanned are scanned, thereby reducing power consumption of the display panel apparently.

DETAILED DESCRIPTION

Technical solutions in embodiments of the present disclosure will be described clearly and completely below by combining with accompany figures. Obviously, the embodiments described below are just a part of embodiments in the present disclosure, but not all the embodiments. Based on the embodiments of the present disclosure, all the other embodiments obtained by those ordinary skilled in the art without paying any inventive labor belong to the scope sought for protection in the present disclosure.

Figure 1:
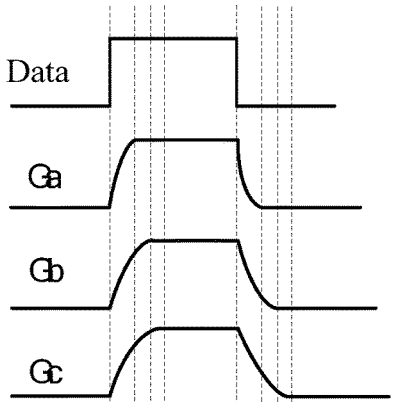
FIG. 1 is a schematic diagram of phase delay of driving signals of GOA units caused by a panel load.

FIG. 1 shows a schematic diagram of phase delay caused by a panel load on driving signals of GOA units. As shown in FIG. 1, when different gate lines are scanned, the phase delay of the driving signal of the GOA unit caused by the panel load is different. For the driving signals of GOA units corresponding to three gate lines Ga, Gb and Gc in FIG. 1, a distance between Ga, Gb and Gc and a source driving circuit increases successively, and the driving signals of the respective GOA units also increases successively relative to the phase delay of data signals Data outputted by the source driving circuit. That is, when the gate lines close to the source driving circuit are scanned, the phase delay is relatively short; when the gate lines far away from the source driving circuit are scanned, the phase delay is relatively long. In general, a uniform offset current is set for the driving signals of different GOA units, and the offset current value needs to ensure that the maximum phase delay is smaller than a threshold.

Figure 2:
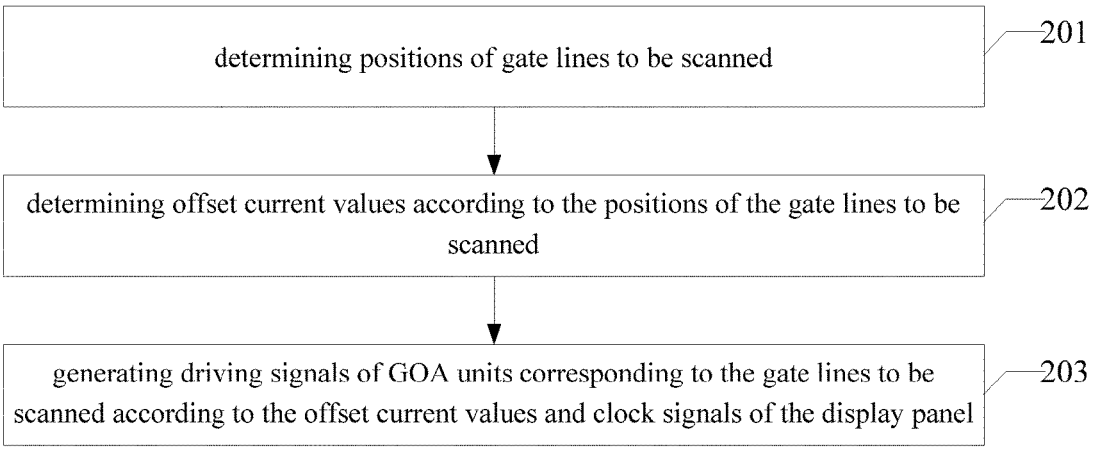
FIG. 2 is a flow schematic diagram of a driving method of a display panel provided in an embodiment of the present disclosure.

FIG. 2 shows a flow schematic diagram of a driving method of a display panel provided in an embodiment of the present disclosure. As shown in FIG. 2, the driving method of the display panel comprises following steps:

In step 201, positions of gate lines to be scanned are determined.

The display panel comprises L rows of gate lines, L is a positive integer, and the value of L is determined depending on a resolution of the display panel. For example, for a wide extended graphics array (WXGA) with a resolution of 800×1280, L is 1280, which represents that the display panel has 1280 rows of gate lines.

The display panel further comprises a GOA circuit configured to provide gate driving signals for the L rows of gate lines. When the display panel operates normally, the GOA circuit scans progressively the L rows of gate lines by the gate driving signals. Within one scanning cycle, it needs to perform one time of scanning on each row of the L rows of gate lines. At any moment in the process of scanning, the gate lines to be scanned may be any row of the L rows of gate lines. Therefore, the positions of the gate lines to be scanned change constantly in the process of scanning.

In step 202, the offset current values are determined according to the positions of the gate lines to be scanned.

The offset current in the embodiments of the present disclosure refers to the offset current of the driving signals of the GOA unit.

Exemplarily, the GOA circuit can comprise GOA units connected in cascades. Different gate lines on the display panel are corresponding to different GOA units. The deriving signals of the GOA units are used to drive the GOA units to output gate driving signals, so as to gate and/or scan the gate lines to be scanned.

The offset current values are related with the positions of the gate lines to be scanned. When the gate lines in the display panel are scanned, for each row of gate lines, there is one offset current value corresponding thereto. Amplitudes of offset current values corresponding to different gate lines may be unequal or equal. For example, within one scanning cycle, the amplitude of the offset current value maintains unchanged within certain period of time. Within this period of time, the amplitudes of the offset current values corresponding to the scanned gate lines are equal. Further, after a certain period of time, the offset current values jump once. Then, the amplitudes of the offset current values corresponding to the scanned gate lines after the offset current values jump are unequal to the offset current values corresponding to the scanned gate lines before the offset current value jumps.

In step 203, driving signals of GOA units corresponding to the gate lines to be scanned are generated according to the offset current values and clock signals of the display panel.

Within one scanning cycle, the driving signals of the GOA units maintain in synchronous with the clock signals of the display panel.

After the offset current values are determined according to the positions of the gate lines to be scanned, the driving signals of the GOA units corresponding to the gate lines to be scanned are generated according to the offset current values. The driving signals of the GOA unit and the clock signals of the display panel are outputted synchronously to drive the GOA units corresponding to the scanned gate lines to output gate driving signals, so as to gate and scan the gate lines to be scanned.

The driving method of the display panel provided in the embodiments of the present disclosure determines the offset current values according to the positions of the gate lines to be scanned by determining the positions of the gate lines to be scanned, and generates the driving signals of the GOA units corresponding to the gate lines to be scanned according to the offset current values and the clock signals of the display panel, so as to complete scanning of the gate lines to be scanned. In a general driving method of the display panel, same offset current values are configured for the L rows of gate lines. In fact, when the gate lines have different positions, amplitudes of the offset current values as required are not completely the same. In order to ensure that the display panel displays normally when all the gate lines are scanned, the offset current values configured in general circumstance are always obtained from a maximum value of the offset current values actually needed by the respective gate lines. For the gate lines which can ensure the normal display by only requiring relatively small offset current values, if the configured offset current values are large, it would result in power consumption waste. The embodiments of the present disclosure determines the offset current values according to the positions of the gate lines to be scanned, and the amplitudes of the offset current values only need to ensure the normal display of the display panel when the gate lines to be scanned are scanned, thereby reducing power consumption of the display panel evidently.

Figure 3:
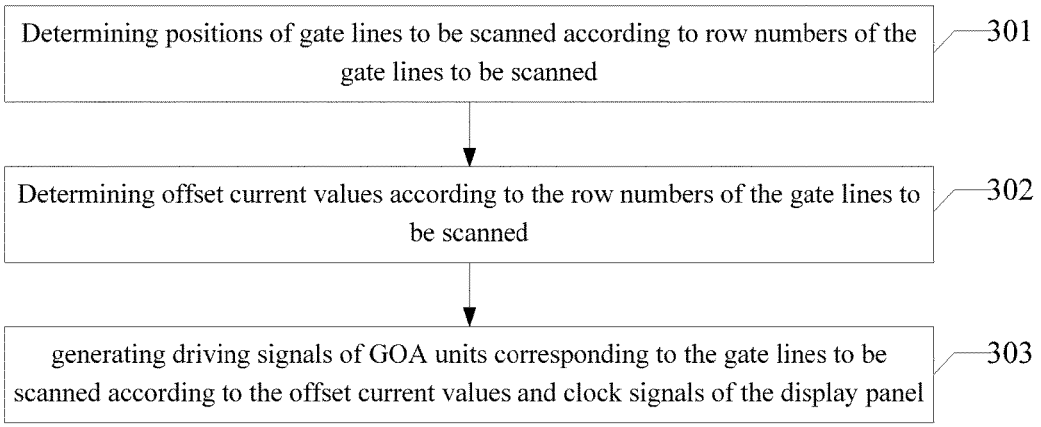
FIG. 3 is a flow schematic diagram of a driving method of a display panel provided in another embodiment of the present disclosure.

FIG. 3 shows a flow schematic diagram of a driving method of a display panel provided in another embodiment of the present disclosure. Referring to FIG. 3, the driving method of the display panel comprises following steps:

In step 301, positions of gate lines to be scanned are determined.

Within one scanning cycle, it needs to scan the L rows of gate lines at a time. At any moment in the process of scanning, the gate lines to be scanned are likely to be any row of the L rows of gate lines. Therefore, the positions of the gate lines to be scanned change constantly in the process of scanning. Optionally, the positions of the gate lines to be scanned are the row numbers of the gate lines to be scanned. For example, for a portrait WXFA panel with a resolution of 800×1280, the display panel comprises 1280 rows of gate lines, whose row numbers are G1, G2, . . . , G1280, wherein the greater the distance between the source driving circuits the gate line has, the larger the corresponding row number is.

In a specific application scenario, within one scanning cycle, the gate lines are scanned in incremental order of the row numbers. Then, when the frame start signal (start vertical) (STV) appears, the row number of the gate lines to be scanned is 1. Further, for every one clock pulse vertical (CPV) cycle, the row number of the gate lines to be scanned increases 1. Thus, in the process of scanning, the positions of the gate lines to be scanned can be determined by counting the row number.

In step 302, the offset current values are determined according to the row numbers of the gate lines to be scanned.

The offset current values are related with the positions of the gate lines to be scanned, and a position of each of the gate lines to be scanned is corresponding to one offset current value. The present embodiment gives examples of the specific correspondence relationship between the positions of the gate lines to be scanned and the offset current values as well as the process of determining the offset current values by combining with two kinds of specific application scenarios.

In a first kind of application scenario, the offset current configuration list is looked up according to the row numbers of the gate lines to be scanned, and the offset current values corresponding to the row numbers of the gate lines to be scanned are determined. Herein, in the offset current configuration list, each row number of the L rows of gate lines is corresponding to one offset current value.

For example, the amplitude of the offset current values can be configured as 16 levels. Each level is represented by a 16 binary code between 00h-0FH in incremental order. In the offset current configuration list, the offset current values actually configured can comprise part or all of 16 levels.

Optionally, in the offset current configuration list, the offset current value corresponding to each row number has a linear relationship with the distance between the gate line of the row number and the source driving circuit. The linear relationship herein referred to comprises a linear function relationship, where a slope of the linear function can be 0.

Figure 4:
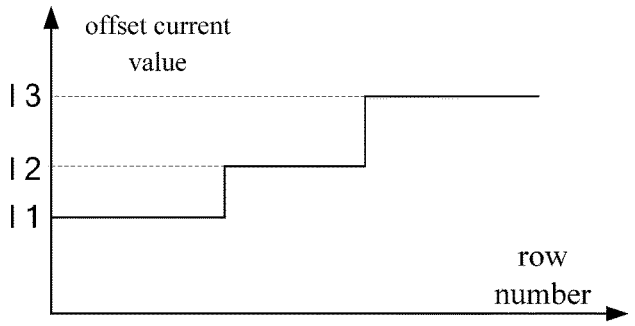
FIG. 4 is a schematic diagram of a variation relationship between offset current values corresponding to gate lines and row numbers.

FIG. 4 shows a schematic diagram of variation relationship between the offset current values corresponding to the gate lines and the row numbers. By combining with that shown in FIG. 4, the offset current value maintains unchanged within a period of time of one scanning cycle, and jumps one time after a predetermined period of time. Exemplarily, the display panel comprises L rows of gate lines, whose row numbers are G1, G2, . . . , GL. Furthermore, in the L rows of gate lines, the greater the distance between a gate line and the source driving circuit is, the larger the row number corresponding to the gate line is. For the gate line having a greater distance from the source driving circuit, it needs a relatively large offset current value so as to ensure the normal display of the display panel. Therefore, for any two adjacent gate lines Gn and Gn+1, the offset current value corresponding to Gn+1 is greater than or equal to the offset current value corresponding to Gn. In FIG. 3, the values of the offset current are actually divided into three levels, i.e., I1, I2, and I3, where I1, I2, and I3 are values between 00h-0FH, and represent one offset current value, and I1<I2<I3.

Alternatively, the L rows of gate lines comprise at least one group of consecutive predetermined row numbers of gate lines corresponding to the same offset current value, where the predetermined row numbers are smaller than L. Exemplarily, in the offset current configuration list, the L rows of gate lines are divided into several groups, wherein each group comprises consecutive gate lines of predetermined row numbers, and the quantity of consecutive gate lines included in different groups may be same or different. It could be understood that if the predetermined row number is 1, then the consecutive predetermined row numbers of gate lines refer to only one row of gate lines.

The following table is an example of the offset current configuration list. The value of L is 1280. 1280 rows of gate lines are divided into six groups. The six groups are corresponding to six levels of the offset current, i.e., 00h, 03h, 06h, 09h, 0Ch and 0Fh. The group having a larger row number is corresponding to a greater offset current value. As the distance between the gate lines to be scanned and the source driving circuit increases constantly, the offset current value is increased in a stepped way since the phase delay of the driving signals of the GOA units caused by the panel load increases. When different gate lines are scanned, the phase delay of the driving signals of different GOA units could be controlled within certain scope.

TABLE 1

| Row Number | Offset Current Value |
|---|---|
| (G1, . . . G239) | 00h |
| (G240, . . . G479) | 03h |
| (G480, . . . G719) | 06h |

TABLE 1-continued

| Row Number | Offset Current Value |
|---|---|
| (G720, . . . G959) | 09h |
| (G960, . . . G1279) | 0Ch |
| (G1280) | 0Fh |

Of course, the L rows of gate lines can be divided into more or less groups, for example, comprising only two groups, or comprising 16 groups. The maximum value of the grouping number is the number of the configurable value of the offset current.

In a first kind of application scenario, by debugging the display panel, the offset current configuration list is set. Within one scanning cycle, the offset current values corresponding to the row numbers of the gate lines to be scanned are determined by determining the row numbers of the gate lines to be scanned and looking up the offset current configuration list according to the row numbers. In a second kind of application scenario, by a predetermined formula, the offset current values corresponding to the gate lines to be scanned are calculated and obtained.

For example, the predetermined formula is a function of the offset current I with respect to the row number Gn of the gate lines to be scanned. Optionally, the predetermined formula can be i=k*[Gn/M]+I, where M is a predetermined row number, k and I are predetermined values, and [N/M] is an rounding operation. In particular, by taking that k is 3, M is 240, and I is 00h as an example, when the row number Gn of the gate lines to be scanned is greater than or equal to 1 and smaller than 240, k*[Gn/M]=00h. At this time, the offset current i is 00h. When the row number Gn of the gate lines to be scanned is equal to 240, k*[Gn/M]=03h. At this time, the offset current i is 03h. Further, for each gate line included in the display panel, a corresponding offset current value can be determined according to its row number.

In step 303, the driving signals of the GOA units corresponding to the gate lines to be scanned are generated according to the offset current values and the clock signals of the display panel.

Within one scanning cycle, the positions of the gate lines to be scanned change in synchronous with the clock signals of the display panel, and the driving signals of the GOA units also keep synchronous with the clock signals of the display panel. The sequence for scanning the L rows of gate lines may be in descending order, in incremental order or in order from middle to the two sides according to the row numbers. The present embodiment is described by just taking the incremental scanning order according to the row number as an example.

After the offset current value is determined according to the position of the gate lines to be scanned, the driving signals of the GOA units corresponding to the gate lines to be scanned are generated according to the offset current value, and the driving signals of the GOA units are outputted in synchronous with the clock signals of the display panel.

Figure 5:
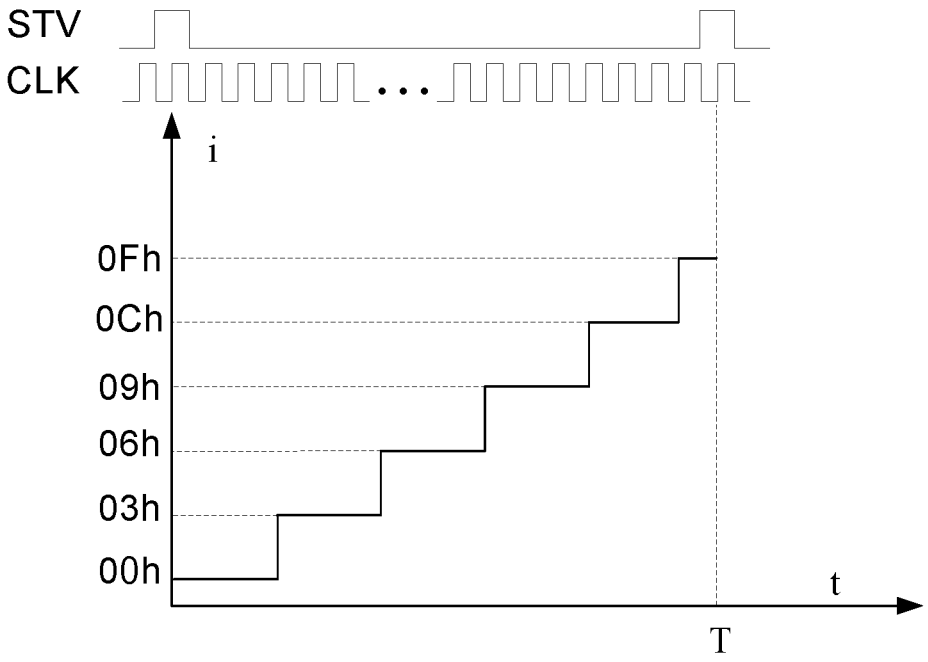
FIG. 5 is schematic diagram of offset current values of driving signal of GOA units varying with clock signals of a display panel.

FIG. 5 shows a schematic diagram that the offset current value of the driving signals of the GOA units varies with the clock signals of the display panel. By combining with the second kind of application scenario in step 302, FIG. 5 shows a schematic diagram of the offset current value of the driving signals of the GOA units varying with the clock signal CLK of the display panel when the predetermined formula is i=3*[Gn/240]+00h. In FIG. 5, the horizontal axis is time, which is represented by t in the figure, and the vertical axis is the offset current, which is represented by i. FIG. 5 takes the time interval between two STVs as one scanning cycle T. Within one scanning cycle, as the clock signals of the display panel change, the offset current value jumps once after a certain time, and increases from the minimum value 00h to the maximum value 0Fh gradually. Of course, the time interval between every two times of jumps may be the same or different, to which the embodiment of the present disclosure does not limit.

The driving signals of the GOA units outputted in synchronous with the clock signals of the display panel drive the GOA units corresponding to the scanned gate lines to output the gate driving signal, so as to gate and scan the gate lines to be scanned. In general, the driving signals of the GOA units comprise at least one clock driving signal. Further, when the GOA units corresponding to the gate lines to be scanned is the first stage of GOA units, the driving signals of the GOA units further comprise STV.

The driving method of the display panel provided in the embodiments of the present disclosure determines the offset current value according to the position of the gate lines to be scanned by determining the position of the gate lines to be scanned, and generates the driving signals of the GOA units corresponding to the gate lines to be scanned according to the offset current value and the clock signals of the display panel, so as to complete scanning of the gate lines to be scanned. In a general driving method of the display panel, same offset current values are configured for the L rows of gate lines. In fact, when the positions of the gate lines are different, amplitudes of the required offset current values are not completely the same. In order to ensure that the display panel displays normally when all the gate lines are scanned, the offset current value configured in general circumstance is always obtained from a maximum value of the offset current values actually needed by the respective gate lines. For the gate lines which can ensure the normal display with relatively small offset current values, if the configured offset current value is large, it would result in power consumption waste. The embodiments of the present disclosure determines the offset current values according to the positions of the gate lines to be scanned, and the amplitudes of the offset current values only need to ensure the normal display of the display panel when the gate lines to be scanned are scanned, thereby reducing power consumption of the display panel evidently.

Figure 6:
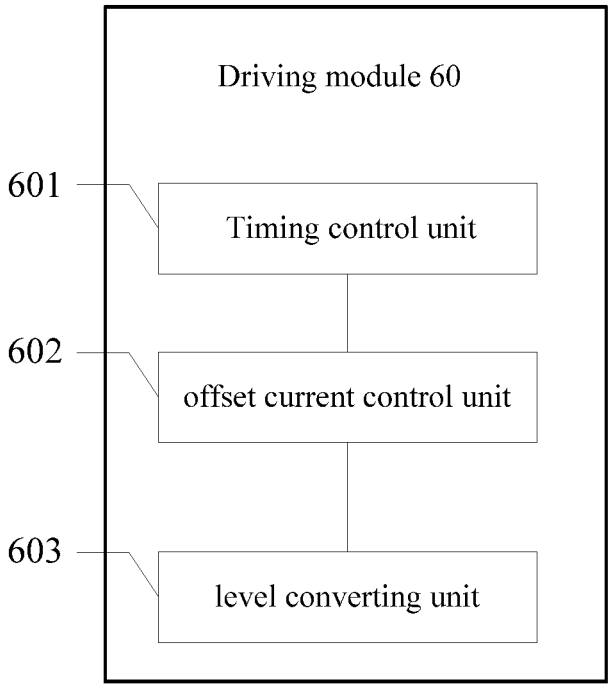
FIG. 6 is a schematic diagram of a structure of a driving module of a display panel provided in another embodiment of the present disclosure.

FIG. 6 shows a schematic diagram of a structure of a driving module of a display panel provided in another embodiment of the present disclosure. The driving module of the display panel as shown in FIG. 6 can be configured to implement the driving method of the display panel described in the embodiments described above. As shown in FIG. 6, the driving module 60 comprises:

a timing control unit 601, configured to determine positions of gate lines to be scanned;

an offset current control unit 602, configured to determine offset current values according to the positions of the gate lines to be scanned; and a level converting unit 603, configured to generate driving signals of GOA units corresponding to the gate lines to be scanned according to the offset current values and clock signals of the display panel.

Those skilled in the art could understand that the driving module processor 60 of the display panel is likely to be a central processing unit (CPU), or an application specific integrated circuit (ASIC), or to be configured as one or more integrated circuits of the embodiments of the present disclosure, and functions described in the embodiments of the present disclosure are implemented by a combination of hardware and software.

The driving module of the display panel provided in the embodiment of the present disclosure determines the offset current values according to the positions of the gate lines to be scanned, and further generates the driving signals of the GOA units corresponding to the gate lines to be scanned according to the offset current and the clock signals of the display pane, so as to complete scanning of the gate lines to be scanned. Compared with the driving method in the prior art that configures the same offset current for the L rows of gate lines, the power consumption of the display panel is reduced.

Optionally, the position of the gate lines to be scanned is the row number of the gate lines to be scanned.

The offset current control unit 602 can be for example configured to look up the offset current configuration list according to the row numbers of the gate lines to be scanned, and determine the offset current values corresponding to the row numbers of the gate lines to be scanned.

Optionally, in the offset current configuration list, each row number of the L rows of gate lines is corresponding to one offset current value.

Optionally, in the offset current configuration list, the offset current value corresponding to each row number has a linear relationship with the distance between the gate line of the row number and the source driving circuit.

Optionally, the L rows of gate lines comprise at least one group of consecutive gate lines of a predetermined row number corresponding to the same offset current value, where the predetermined row number is smaller than L.

Optionally, the offset current control unit 602 can be for example configured to calculate and obtain the offset current values corresponding to the positions of the gate lines to be scanned through a predetermined formula.

The driving module of the display panel provided in the embodiment of the present disclosure determines the offset current value according to the position of the gate lines to be scanned by determining the position of the gate lines to be scanned, and generates the driving signals of the GOS units corresponding to the gate lines to be scanned according to the offset current value and the clock signals of the display panel, so as to complete scanning of the gate lines to be scanned. In a general driving method of the display panel, the same offset current values are configured for the L rows of gate lines. In fact, when the gate lines have different positions, amplitudes of the required offset current values are not completely the same. In order to ensure that the display panel displays normally when all the gate lines are scanned, the offset current value configured in general circumstance is always obtained from a maximum value of the offset current values actually needed by the respective gate lines. For the gate lines which can ensure the normal display with relatively small offset current values, if the configured offset current is large, it would result in power consumption waste. The embodiment of the present disclosure determines the offset current values according to the positions of the gate lines to be scanned, and the amplitudes of the offset current values only need to ensure the normal display of the display panel when the gate lines to be scanned are scanned, thereby reducing power consumption of the display panel evidently.

There is further provided in the embodiments of the present disclosure a display panel, comprising the driving module described above. Furthermore, there is provided in the embodiments of the present disclosure a display apparatus, comprising the display panel described above. The display apparatus could be an electronic paper, a mobile phone, a television set, and a digital photo frame and so on. It is capable of determining the corresponding offset current according to the position of the gate lines to be scanned, generating the driving signals of the GOA units corresponding to the gate lines to be scanned according to the offset current and the clock signals of the display panel, and outputting the driving signals of the GOA units in synchronous with the clock signals of the display panel. Compared with the manner of configuring the same offset current for all the gate lines in the prior art, the present embodiment reduces the power consumption.

Through the description of the implementations described above, it is clear for those skilled in the art to know that the present disclosure can be implemented by hardware or firmware or combination thereof. For example, when the present disclosure is implemented by using software, the above function can be stored in a computer-readable medium or transmitted as one or more instructions or codes on the computer-readable medium. The computer-readable medium comprises computer storage medium and communication medium, wherein the communication medium comprises any medium which is convenient for transmitting a computer program from one place to another place. The storage medium can be any available medium being accessible to the computer. The present disclosure just takes it as an example, but is not limited to the following: the computer-readable medium can comprise a random access memory (RAM), a read only memory (ROM), an electrically erasable programmable read only memory (EEPROM), a compact disc read only memory (CD-ROM) or other optical disk memory, magnetic disc storage medium or other magnetic storage device, or any other medium which is capable of carrying or storing the desired program code having instructions or data structure forms and is capable of being accessible to the computer. As used in the present disclosure, disc and disk comprises a compact disc (CD), a laser disk, an optical disc, a digital versatile disc (DVD), a soft disk and a blue-ray disk, wherein the disk always duplicates data magnetically, while disk duplicates the data optically by using laser. Any combination of the above shall also be included within the protection scope of the computer-readable medium.

The above descriptions are just specific implementations of the present disclosure, but the protection scope of the present disclosure is not limited thereto. Any alternation or replacement easily conceived by those skilled in the art who are familiar with the technical field within the technical scope disclosed in the present disclosure. Therefore, the protection scope of the present disclosure shall be subjected to the protection scope of the Claims.

The present application claims the priority of a Chinese patent application No. 201510292713.4 filed on May 29, 2015. Herein, the content disclosed by the Chinese patent application is incorporated in full by reference as a part of the present disclosure.

What is claimed is:

1. A driving method of a display panel which comprises a gate driver on array (GOA) circuit and L rows of gate lines, the GOA circuit providing gate driving signals to the L rows of gate lines, and the L being a positive integer, the method comprising:

determining positions of gate lines to be scanned;

looking up an offset current configuration list according to the positions of gate lines to be scanned;

determining offset current values according to the positions of the gate lines to be scanned; and generating driving signals of GOA units corresponding to the gate lines to be scanned according to the offset current values and clock signals of the display panel.

2. The method according to claim 1, wherein the positions of the gate lines to be scanned are row numbers of the gate lines to be scanned.

3. The method according to claim 2, wherein in the offset current configuration list, each row number of the L rows of gate lines is corresponding to one offset current value.

4. The method according to claim 3, wherein in the offset current configuration list, an offset current value corresponding to each of the row numbers has a linear relationship with a distance between a gate line of the row number and a source driving circuit.

5. The method according to claim 4, wherein the L rows of gate lines comprise at least a group of consecutive gate lines of a predetermined row number corresponding to a same offset current value, where the predetermined row number is smaller than L.

6. The method according to claim 1, wherein the determining offset current values according to positions of gate lines to be scanned comprises:

calculating and obtaining offset current values corresponding to the positions of the gate lines to be scanned by a predetermined formula.

7. The method according to claim 1, wherein the driving signals of the GOA units comprise at least one clock driving signal; when the GOA unit corresponding to the gate lines to be scanned is a GOA unit of a first stage, the driving signals of the GOA units further comprise a frame start signal STV.

8. A driving circuit for a gate driver on array (GOA) circuit, the GOA circuit providing gate driving signals to L rows of gate lines and the L being a positive integer, wherein the driving circuit comprises at least one of a central processing unit, an application specific integrated circuit, or an integrated circuit, and the driving circuit performs the following functions:

determining positions of gate lines to be scanned;

looking up an offset current configuration list according to the positions of gate lines to be scanned;

determining offset current values according to the positions of the gate lines to be scanned; and generating driving signals of GOA units corresponding to the gate lines to be scanned according to the offset current values and clock signals.

9. The driving circuit according to claim 8, wherein the positions of the gate lines to be scanned are row numbers of the gate lines to be scanned.

10. The driving circuit according to claim 9, wherein in the offset current configuration list, each row number of the L rows of gate lines is corresponding to one offset current value.

11. The driving circuit according to claim 10, wherein in the offset current configuration list, the offset current value corresponding to each of row numbers has a linear relationship with a distance between the gate line of the row number and a source driving circuit.

12. The driving circuit according to claim 8, wherein the L rows of gates comprise at least a group of consecutive gate lines of a predetermined row number corresponding to a same offset current value, where the predetermined row number is smaller than L.

13. The driving circuit according to claim 8, wherein the driving circuit further performs the following functions:

calculating and obtaining offset current values corresponding to the positions of the gate lines to be scanned by a predetermined formula.

14. A display panel, comprising the driving circuit according to claim 8.

15. A display apparatus, comprising the display panel according to claim 14.

16. The display panel according to claim 14, wherein the positions of the gate lines to be scanned are row numbers of the gate lines to be scanned.

17. The display panel according to claim 16, wherein in the offset current configuration list, each row number of the L rows of gate lines is corresponding to one offset current value.

18. The display panel according to claim 17, wherein in the offset current configuration list, the offset current value corresponding to each of row numbers has a linear relationship with a distance between the gate line of the row number and a source driving circuit.

19. The display panel according to claim 14, wherein the L rows of gates comprise at least a group of consecutive gate lines of a predetermined row number corresponding to a same offset current value, where the predetermined row number is smaller than L.

20. The display panel according to claim 14, wherein the driving circuit further performs the following functions:

calculating and obtaining offset current values corresponding to the positions of the gate lines to be scanned by a predetermined formula.

* * * * *